US005340113A

United States Patent [19]

Respicio

[11] Patent Number: 5,340,113

[45] Date of Patent: Aug. 23, 1994

[54] METHOD OF PLAYING A BOARD GAME

[76] Inventor: Fred E. Respicio, 95-1123 Lalai St., Mililani, Hi. 96789

[21] Appl. No.: 124,579

[22] Filed: Sep. 22, 1993

[51] Int. Cl.[5] ..... A63F 3/00

[52] U.S. Cl. ..... 273/249; 273/138 R; 273/290

[58] Field of Search ..... 273/138 R, 290, 291, 273/249-254, 293, 256

[56] References Cited

U.S. PATENT DOCUMENTS

| | | | |
|---|---|---|---|
| 1,707,323 | 4/1929 | Schaffer | 273/249 |
| 2,780,463 | 2/1957 | Salomon | 273/249 |
| 4,291,884 | 9/1981 | Bass et al. | 273/249 |
| 5,071,134 | 12/1991 | Burroughs | 273/249 |

OTHER PUBLICATIONS

Promo, Aug. 1993, p. 33 "Attendance, Grosses Up At Hawaii Fair".

News & Observer (Raleigh, N.C.), Jun. 11, 1993, p. C7, "Pogshead Revisited".

Los Angeles Times, Monday, Aug. 30, 1993, Metro p. 4 pt. B col. 1, "Milking the latest collectors' craze for fun and profit" by John Glionna.

The Associated Press, Dateline: Honolulu Priority, Sep. 5, 1993, "Pogs".

Los Angeles Times, Sunday, Jul. 18, 1993, Metro p. 1 pt. B col. 5, "Pog or Trov—Children Are Flipping Over It" by Gebe Martinez.

Los Angeles Times, Friday, Jul. 30, 1993, Metro p. 3 pt. B col. 1 "Hawaiian Game Has Dealers" Pog-wild by Ted Johnson.

Candy Marketer, Jul. 1993 p. 25 "Skybox hopes to milk new kids' craze".

Amusement Business, Aug. 2, 1993, p. 65 "POG's are expected to be the next hula-hoop".

Advertising News, Mar. 8, 1993, p. 1, "Hawaiian institutions help spread POG mania".

Hawaii Business, May 1993, p. 11, "Eden Prairie company profits from POG craze that's still in its infancy".

Star Tribune (Minneapolis, Minn.), May 12, 1993, p. D2 "POGs swarm islands, bankers".

Los Angeles Times, Monday, Jun. 7, 1993, p. 5 pt. A col. 1, "Honolulu-Hawaii has gone 'POG' wild" by Susan Essoyan.

*Primary Examiner*—Benjamin H. Layno

*Attorney, Agent, or Firm*—Michael I. Kroll

[57] ABSTRACT

A board game is provided which consists of a game board having a generally spiraled type path of travel in a clockwise direction divided into consecutive playing position spaces a plurality of playing pieces one for each player, and a chance device for determining the movement of the playing pieces. The chance device is similar to the Hawaiian game called Pogs which uses a plurality of milk caps or disks each having an identifiable indicia on a first face, and a hitter disk. The disks are stacked with the first faces turned down. Each player takes turns throwing the hitter disk toward the stack knocking the stack over and toppling the disks. The respective playing piece moves the number of playing position spaces equal to the number of disks turned over with their first face up.

13 Claims, 2 Drawing Sheets

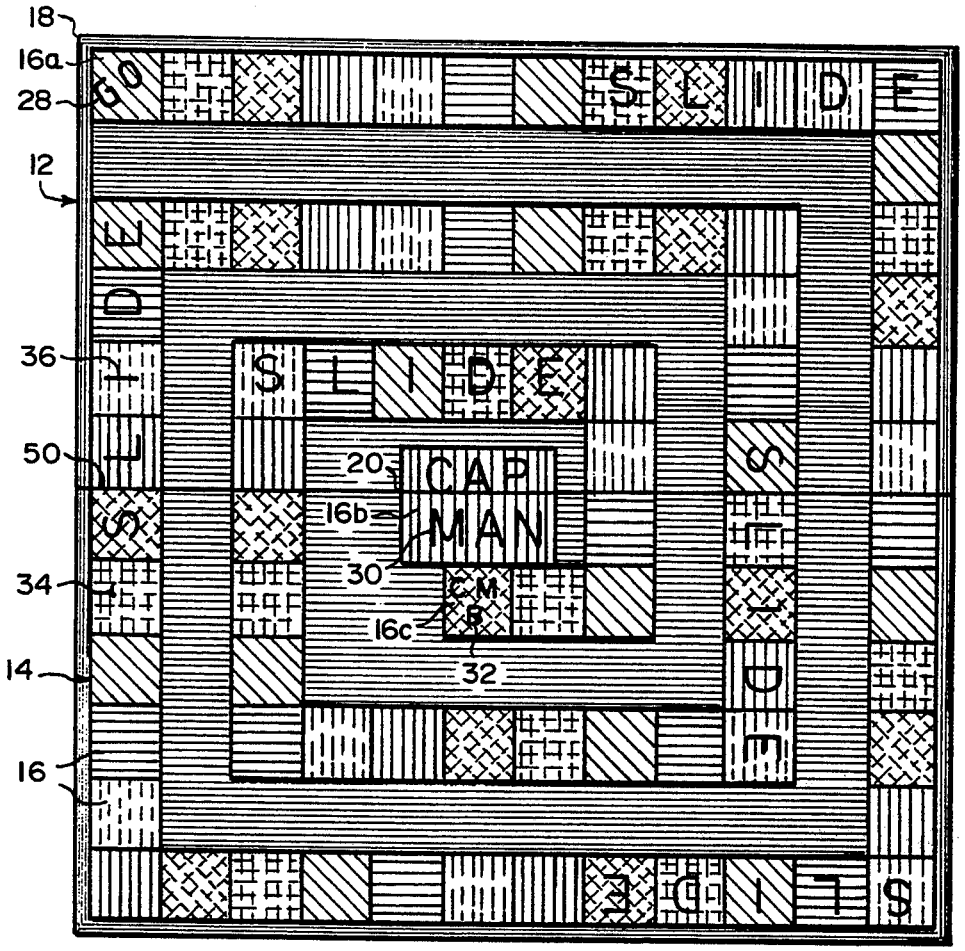
Fig 4
Fig 5
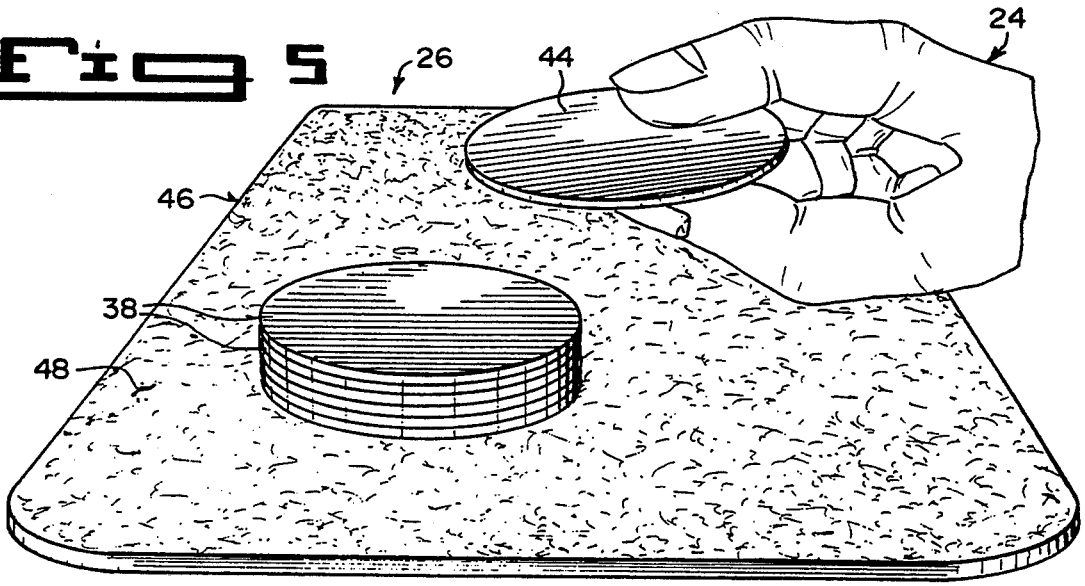

METHOD OF PLAYING A BOARD GAME

BACKGROUND OF THE INVENTION

1. Field of the Invention

The instant invention relates generally to board games and more specifically it relates to a cap man game.

2. Description of the Prior Art

Numerous board games have been provided in prior art that are each adapted to utilize chance determining equipment, such as dice, a spinner, etc. in order to indicate the number of moves to be made around a playing field by playing pieces on a game board. While these units may be suitable for the particular purpose to which they address, they would not be as suitable for the purposes of the present invention as heretofore described.

SUMMARY OF THE INVENTION

A primary object of the present invention is to provide a cap man game that will overcome the shortcomings of the prior art devices.

Another object is to provide a cap man game that utilizes a Hawaiian game called Pogs as the chance determining equipment to indicate the number of moves to be made by each playing piece.

An additional object is to provide a cap man game which includes a game board, playing pieces and chance determining equipment that is stored within a game box when not being used.

A further object is to provide a cap man game that is simple and easy to use.

A still further object is to provide a cap man game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 4 is a top view of the game board opened.

FIG. 5 is a perspective view showing how to use the chance determining equipment, so as to indicate the number of moves to be made by each of the playing pieces along a path of travel on the game board.

DETAILED DESCRIPTION OF THE PREFERRED EMBODIMENTS

Figure 1:
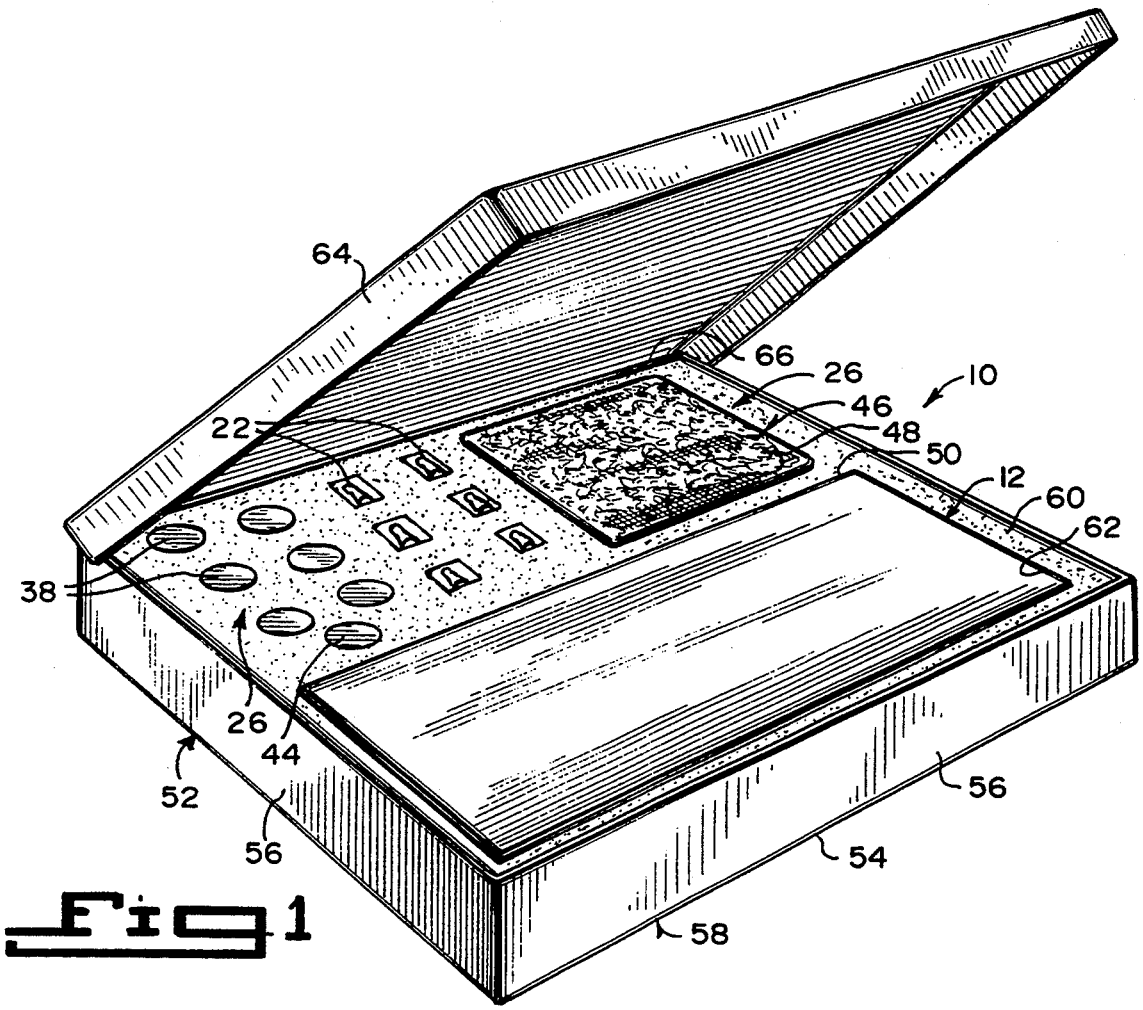
FIG. 1 is a perspective view of a game box with its lid partly opened, showing the various components of the instant invention therein.

Turning now descriptively to the drawings, in which similar reference characters denote similar elements throughout the several views, FIGS. 1 through 5 illustrate a cap man game 10, which consists of a game board 12, as best seen in FIG. 4, having a generally spiraled type path of travel 14 in a clockwise direction divided into consecutive playing position spaces 16, substantially covering the entire playing board 12. The path of travel 14 starts from a first playing position space **16*a* at a corner 18 of the game board 12 and ends at a last playing position spaced 16*b* in the center 20 of the game board 12. A plurality of playing pieces 22 are also provided, with one for each of the game players 24. Each playing piece 22 is of a size to fit within the playing position spaces 16 and is differently identifiable, such as by shape or color, to represent one of the game players 24. Chance determining equipment 26 is for producing a random output count representing a number of the playing position spaces 16 to be moved by each playing piece 22**.

The first playing position space **16*a* on the game board 12 includes indicia 28 being the word "GO", from which the game 10 starts. The last playing position space 16*b* on the game board 12 includes indicia 30 being the words "CAP MAN", in which the game 10 ends. The next to last playing position space 16*c* on the game board 12 includes indicia 32** being the letters "CMB", which is an abbreviation for the words "CAP MAN BLOCK".

All of the playing position spaces 16, **16*a*, 16*b* and 16*c* includes indicia 34 being a plurality of different colors in a repetitive sequence, in which one color is for each playing position space 16, 16*a*, 16*b* and 16*c*. Some of the playing position spaces 16 contain indicia 36 being the letters "S", "L", "I", "D", "E", in a consecutive order, in which one letter is for each playing position space 16**.

Figure 2:
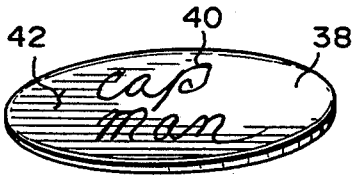
FIG. 2 is a perspective view of one of the cap disks used in the game.
Figure 3:
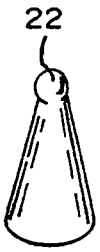
FIG. 3 is a perspective view of one of the playing pieces.

The chance determining equipment 26 utilizes the Hawaiian game called "POGS" and includes a plurality of cap disks 38, each having identifiable indicia 40 on a first face 42, as shown in FIG. 2. A cap hitter disk 44 is also provided. The cap disks 38 are stacked with the identifiable indicia 40 on each first face 42 turned down, as shown in FIG. 5. Each player 24 then takes a turn hitting the stacked cap disks 38 with the cap hitter disk 44, so as to turn over the cap disks 38 with the first face 42 up and moves the respective playing piece 22 the number of the playing position spaces 16, equal to the number of the cap disks 38 turned over with the first face 42 up. The identifiable indicia 40 on each first face 42 on each cap disk 38 are the words "CAP Man".

The chance determining equipment 26 further includes a hitting board 46, which is positioned horizontally on a flat surface, so that the cap disks 38 can be stacked thereon and hit by the cap hitter disk 44. The hitting board 46 contains a felt covering 48 thereabout, so as to act as a cushion when the stacked cap disks 38 are hit by the cap hitter disk 44.

The game board 12 is square shaped and includes a central fold line 50 thereacross. The game board 12 can be folded in half in a closed positioned and be rectangular shaped, as shown in FIG. 1, to take up less room stored when not being used.

The cap man game 10, as shown in FIG. 1, further contains a game box 52 for storing the folded game board 12, the playing pieces 22, the cap disks 38, the cap hitter disk 44 and the hitting board 46 therein. The game box 52 includes a base 54 and four side walls 56 extending upwardly from the base 54, forming a substantially rectangular shaped housing 58. A top wall 60 is raised above the base 54 and has a plurality of recessed storage compartments 62. Each is shaped for holding the folded game board 12, the playing pieces 22, the cap disks 38, the cap hitting disk 44 and the hitting board 46 therein.

A lid 64 is hinged at one side 66 to a top edge of one side wall 56, so as to cover over the housing 58.

RULES OF THE GAME

1. At the start of the game, each player places their playing piece on the first playing position space 16*a*.

2. Each player 24 then uses the chance determining equipment 26 to see who goes first.

3. The first player 24 to flip over the most cap disks 38 goes first, the second player 24 to flip over the next amount of cap disks 38 goes second and so on.

4. The first player then uses the chance determining equipment 26 again.

5. The respective playing piece 22 is then moved as many playing position spaces 16 as cap disks 38 flipped over.

6. If a first playing piece 22 lands on a playing position space 16 with a second playing piece 22, the second player piece 22 is sent back five playing position spaces 16, or to the first playing position space 16*a*, if the game just started.

7. If a playing piece 22 lands on a playing position space 16 with the letter "S", it will then slide to the playing position space 16 with the letter "E" and then go onto the next playing positing space 16.

8. If a second playing piece 22 is on any of the other playing position spaces 16 with the letters "L", "I" "D" or , "E" and the first playing piece 22 lands on the playing position space 16 with the letter "S" the second playing piece 22 is then knocked back five playing position spaces 16, before the playing position space 16 with the letter "S".

9. Each playing piece 22 can move along the path of travel 14, until the next to the last playing position space 16*c* is reached.

10. Once the playing piece 22 reaches the next to the last playing position space 16*c*, it cannot be knocked back the five playing position spaces 16.

11. In order for a playing piece 22 to enter the last playing position space 16*b* and be declared the winner, a player must flip over all of the stacked cap disks 38, which are six in number with one hit from the cap hitter disk 44.

12. If a player fails to do this he must wait for his turn and try again.

13. The six stacked cap disks 38 that a player must flip over to win can be changed to a lower amount depending if the children playing the game are younger and aren't able to flip over all of the six stacked cap disks 38.

LIST OF REFERENCE NUMBERS

10 cap man game
12 game board
14 path of travel on 12
16 playing position space of 14
16*a* first playing position space of 14
16*b* last playing position space of 14
16*c* next to last playing position space of 14
18 corner of 12
20 center of 12
22 playing piece for 24
24 game player
26 chance determining equipment
28 indicia being the word "GO" on 16*a*
30 indicia being the words "CAP MAN" on 16*b*
32 indicia being the letter "CMB" on 16*c*
34 indicia being a color on 16, 16*a*, 16*b* and 16
36 indicia being the letters "S", "L", "I", "D", "E" on 16
38 cap disk
40 identifiable indicia being the words "CAP MAN" on 42
42 first face of 38
44 cap hitter disk
46 hitting board
48 felt covering on 46
50 central fold line on 12
52 game box
54 base
56 side wall
58 housing
60 top wall
62 recessed storage compartment in 60
64 lid
66 hinge It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A method of playing a board game comprising the steps of:

a) providing a game board having a generally spiraled type path of travel in a clockwise direction divided into consecutive playing position spaces, substantially covering said entire playing board, wherein said path of travel starts from a first playing position space at a corner of said game board and ends at a last playing position space in the center of said game board;

b) a plurality providing of playing pieces, one for each of the game players, each said playing piece being of a size to fit within said playing position spaces and differently identifiable to represent one of the game players;

c) providing a chance determining means f or producing a random output count representing a number of said playing position spaces to be moved by each said playing piece, said chance determining means includes a plurality of disks, each having identifiable indicia on one face, and a hitter disk;

d) placing each players' playing piece on said first playing position space;

e) determining the order of play;

f) stacking said disks with said identifiable indicia on each disk turned face down;

g) a first player attempting to flip over, identifiable indicia face up, as many disks as possible by throwing said hitter disk toward said stack of disks, wherein when said stack of disks is hit by said hitter disk said stack is knocked down toppling over each of said disks;

h) said player moving his/her respective playing piece the number of said playing position spaces equal to the number of said toppled over disks that are flipped over with their said identifiable indicia face up; and i) repeating steps f)-h) for the next player.

2. A method of playing a board game as recited in claim 1, wherein said first playing position space on said game board includes indicia being the word "GO" from which said game starts.

3. A method of playing a board game as recited in claim 2, wherein said last playing position space on said game board includes indicia being the words "CAP MAN" in which said game ends.

4. A method of playing a board game as recited in claim 3, wherein said next to last playing position space on said game board includes indicia being the letters "CMB" which is an abbreviation for the words "CAP MAN BLOCK".

5. A method of playing a board game as recited in claim 4, wherein all of said playing position spaces includes indicia being a plurality of different colors in a repetitive sequence, in which one said color is for each said playing position space.

6. A method of playing a board game as recited in claim 5, wherein some of said playing position spaces includes indicia being the letters "S", "L", "I", "D", "E" in a consecutive order, one said letter for each said playing position space.

7. A method of playing a board game as recited in claim 1, wherein said identifiable indicia on each said first face on each said disk are the words "CAP MAN".

8. A method of playing a board game as recited in claim 7, wherein said chance determining means further includes a hitting board which is positioned horizontally on a flat surface, so that said disks can be stacked thereon and hit by said hitter disk.

9. A method of playing a board game as recited in claim 8, wherein said hitting board includes a felt covering thereabout, so as to act as a cushion when said stacked disks are hit by said hitter disk.

10. A method of playing a board game as recited in claim 9, wherein said game board is square shaped and includes a central fold line thereacross, so that said game board can be folded in half in a closed position and be rectangular shaped to take up less room stored when not being used.

11. A method of playing a board game as recited in claim 10, further including a game box for storing said folded game board, said playing pieces, said disks, said hitter disk and said hitting board therein.

12. A method of playing a board game as recited in claim 11, wherein said game box includes:

a) a base;

b) four side walls extending upwardly from said base forming a substantially rectangular shaped housing; and c) a top wall raised above said base and having a plurality of recessed storage compartments, each shaped for holding said folded game board, said playing pieces, said disks, said hitting disk and said hitting board therein.

13. A method of playing a board game as recited in claim 12, wherein said game box further includes a lid hinged at one side to a top edge of one said side wall, so as to cover over said housing.

* * * * *